US007874967B2

(12) United States Patent
Schiff

(10) Patent No.: US 7,874,967 B2
(45) **Date of Patent: *Jan. 25, 2011**

(54) ADJUSTABLE-WEIGHT EXERCISE APPARATUS AND METHOD

(76) Inventor: Jon D. Schiff, 4733 Vince Ct., St. Joseph, MI (US) 49085

( * ) Notice: Subject to any disclaimer, the term of this patent is extended or adjusted under 35 U.S.C. 154(b) by 0 days.

This patent is subject to a terminal disclaimer.

(21) Appl. No.: 12/570,482

(22) Filed: Sep. 30, 2009

(65) Prior Publication Data

US 2010/0016130 A1 Jan. 21, 2010

Related U.S. Application Data

(63) Continuation of application No. 11/934,243, filed on Nov. 2, 2007, now Pat. No. 7,611,448.

(51) Int. Cl.
*A63B 21/072* (2006.01)
*A63B 21/075* (2006.01)

(52) U.S. Cl. ..... 482/107

(58) Field of Classification Search ..... 482/44, 482/50, 55, 92–94, 97–98, 104–109; 473/219, 473/226, 256; 403/326, 329; 24/591.1, 593.1, 24/701–702; D21/680–682; *A63B 21/072, A63B 21/075, 21/078*
See application file for complete search history.

(56) References Cited

U.S. PATENT DOCUMENTS

| | | | | |
|---|---|---|---|---|
| 808,008 | A | 12/1905 | Cagle | |
| 1,033,187 | A | 7/1912 | Metzger | |
| 1,536,048 | A | 5/1925 | Alastalo | |
| 1,645,457 | A | 10/1927 | Schall | |
| 3,771,785 | A | 11/1973 | Speyer | |
| 4,453,710 | A | 6/1984 | Plotz | |
| 4,529,197 | A | 7/1985 | Gogarty | |
| 4,585,367 | A | 4/1986 | Gall | |
| 4,738,446 | A | 4/1988 | Miles | |
| 4,787,629 | A | 11/1988 | DeMyer | |
| 4,817,944 | A | 4/1989 | Anderson et al. | |
| 4,955,603 | A | 9/1990 | Becker | |
| 4,971,305 | A | 11/1990 | Rennex | |
| 4,971,318 | A * | 11/1990 | Tracy | 482/107 |
| 5,123,885 | A | 6/1992 | Shields | |
| 5,135,455 | A * | 8/1992 | King et al. | 482/108 |
| 5,163,887 | A | 11/1992 | Hatch | |
| 5,344,375 | A | 9/1994 | Cooper | |

(Continued)

OTHER PUBLICATIONS

The Merriam-Webster Dictionary, definition of "flex", http://www.merriam-webster.com/dictionary/flex.*

*Primary Examiner*—Loan Thanh
*Assistant Examiner*—Oren Ginsberg
(74) *Attorney, Agent, or Firm*—Price, Heneveld, Cooper, DeWitt & Litton, LLP

(57) ABSTRACT

A method of exercising includes steps of providing a rod and weights configured for self-attachment to the rod, assembling at least one weight onto each end of the rod, and securing the weights to the ends by rotating the weights on the rod from a first rotational orientation to an interlocking second rotational orientation. The weights have a hub defining a hole, an undulating outer surface for gripping, and inwardly-extending curved fingers with a slot around the fingers allowing the fingers to flex for frictionally engaging the rod when the weights are rotated on the rod.

12 Claims, 2 Drawing Sheets

U.S. PATENT DOCUMENTS

| | | | |
|---|---|---|---|
| 5,346,449 | A | 9/1994 | Schlagel |
| 5,407,413 | A | 4/1995 | Kupferman |
| 5,435,800 | A | 7/1995 | Nelson |
| 5,464,379 | A | 11/1995 | Zarecky |
| 5,637,064 | A | 6/1997 | Olson et al. |
| 5,839,997 | A | 11/1998 | Roth et al. |
| 6,315,699 | B1 | 11/2001 | Romero |
| 6,971,974 | B2 | 12/2005 | Bowman et al. |
| 7,025,713 | B2 | 4/2006 | Dalebout et al. |
| 7,037,245 | B2 | 5/2006 | Burwell |
| 7,087,000 | B1 | 8/2006 | Walker |
| 7,137,931 | B2 | 11/2006 | Liu |
| 7,172,536 | B2 | 2/2007 | Liu |
| 7,182,716 | B1 | 2/2007 | Dawson |

* cited by examiner

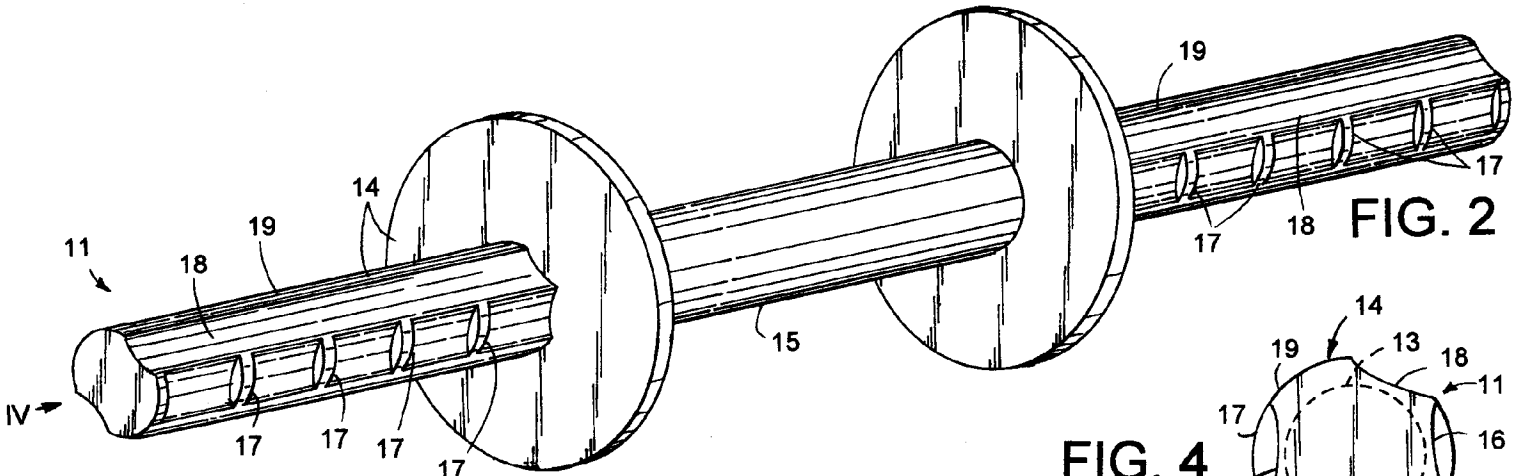
FIG. 2
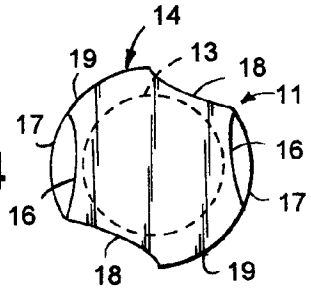
FIG. 4
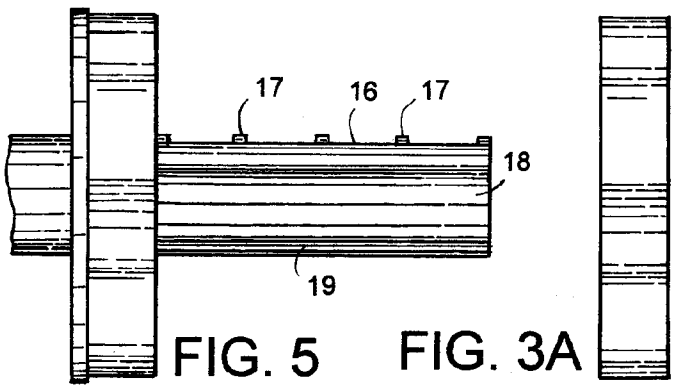
FIG. 5
FIG. 3A
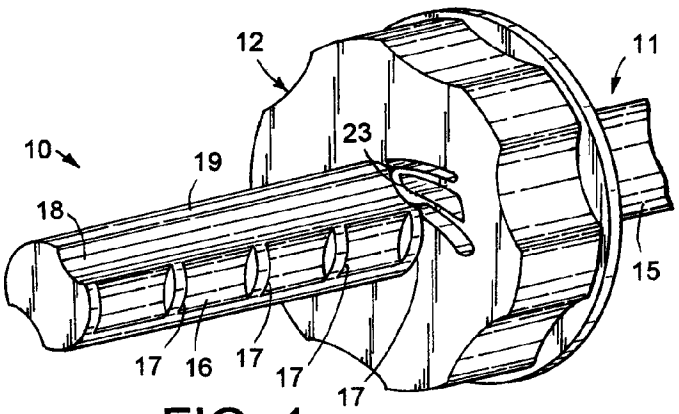
FIG. 1

ADJUSTABLE-WEIGHT EXERCISE APPARATUS AND METHOD

CROSS REFERENCE TO RELATED APPLICATION

This application is a continuation of commonly assigned, co-invented application Ser. No. 11/934,243, filed Nov. 2, 2007 now U.S. Pat. No. 7,611,448, entitled ADJUSTABLE-WEIGHT EXERCISE APPARATUS AND METHOD, the entire contents of which are incorporated herein by reference.

BACKGROUND

The present invention relates to an adjustable-weight exercise apparatus with weights having an integral resilient system for interlockingly engaging a bar handle upon rotation of the weights.

Adjustable-weight exercise equipment such as free weights and dumbbells are popular with people interested in physical fitness, since optimal weights can be selected for particular fitness programs and exercise routines. Typically, the equipment includes a bar (or handle), a plurality of weights attachable to the bar, and locking collars for locking the weights onto ends of the bar. However, often the collars are misplaced or are not located conveniently, causing an interruption to the exercise routine while one searches for the collars. Further, removing the collar to add weights takes up time, delays the workout, and can be inconvenient to the user. Still further, the collar takes up space at the ends of the bar, increasing material cost of the product and also wasting space at an end of the bar.

Some patents and products exist where the exercise equipment's collar is replaced with a selector that can be adjusted to select (or de-select) additional weights. However, these known systems are expensive, complex, and are subject to safety hazards from partial engagement of their selective interlock system. In particular, the structure of many of these known systems involves significant machining and/or forming of the rod, the weights, and/or a selector . . . all of which add considerably to expense. Further, systems that incorporate moving parts, such as a latch or selector pin or selector ribbon, are subject to warranty defects, damage and wear. Further, they often include multiple pieces, and often are not robust. Sometimes, they are not intuitively obvious to operate.

SUMMARY OF THE PRESENT INVENTION

In one aspect of the present invention, a method of exercising comprises steps of providing a rod and weights configured for self-attachment to the rod, assembling at least one weight onto each end of the rod, and securing the weights to the ends by rotating the weights on the rod from a first rotational orientation to an interlocking second rotational orientation.

In another aspect of the present invention, an article includes a weight having a hub defining a hole with a center axis, an outer surface, and at least one inwardly-extending finger that extends from the hub toward the hole; the at least one finger being longitudinally curved in shape and having a tip, a flexible stem and a base, the tip being spaced radially and circumferentially from the base; the hub further including a slot formed around a border of the stem that provides room for the at least one finger to flex in a manner causing the tip to move away from the center axis, whereby the weight is adapted to receive a rod in the hole and thereafter the weight can be rotated to cause the at least one finger to flex and hence cause the tip to frictionally engage a mating surface on the rod.

These and other aspects, objects, and features of the present invention will be understood and appreciated by those skilled in the art upon studying the following specification, claims, and appended drawings.

BRIEF DESCRIPTION OF DRAWINGS

FIG. 1 is a fragmentary perspective view of an adjustable-weight exercise apparatus (shown as a dumbbell) including a rod and weights.

FIG. 2 is a perspective view of the rod/handle in FIG. 1.

FIGS. 3-3A are side and end views of the weights in FIG. 1.

FIG. 4 is an end view of the rod/handle in FIG. 2.

FIG. 5 is a fragmentary side view of an end section of the rod/handle in FIG. 2

DETAILED DESCRIPTION OF PREFERRED EMBODIMENTS

Figure 3:
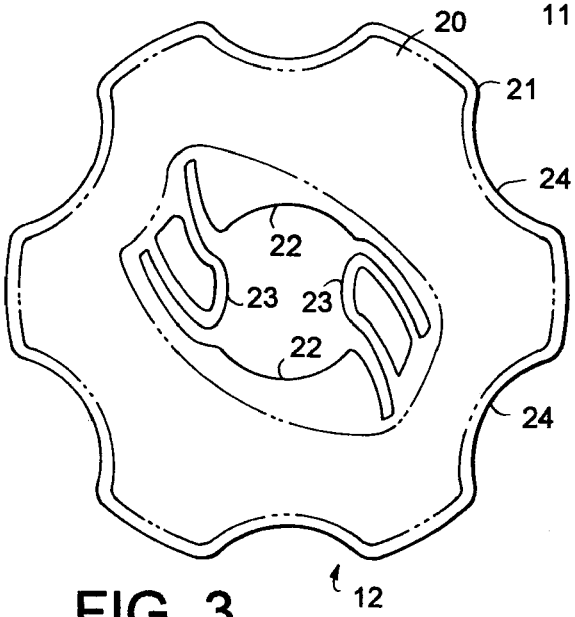

A dumbbell 10 (or any weighted exercise apparatus) includes a rod/handle 11 and a plurality of weights 12. The handle 11 (FIGS. 1-2 and 4-5) includes a metal bar or rod 13 with each end overmolded with an outer layer of material 14 (preferably nylon) to form a particularly shaped cross section. The cross section includes two concave longitudinally-extending locking surfaces 16 with ribs 17 spaced longitudinally, two adjacent concave longitudinally-extending surfaces 18 (without ribs), and two convex longitudinally-extending bearing surfaces 19. The weights 12 (FIGS. 1, 3 and 3A) include an internal metal plate 20 overmolded with a polymeric covering 21 such as acetal (Delrin®). The covering 21 forms a hub with a hole at a center of the plate 20. The hub includes opposing bearing surfaces 22 and a pair of opposing resilient fingers 23. The bearing surfaces 22 engage the bearing surfaces 19 on the handle 11 and permit weights 12 to be slid onto the bar when the fingers 23 are aligned with the concave surfaces 18. (See FIG. 3A.) Notably, a variety of different masses can be provided in the weights 12 by varying a mass of the plate 20.

Figure 6:
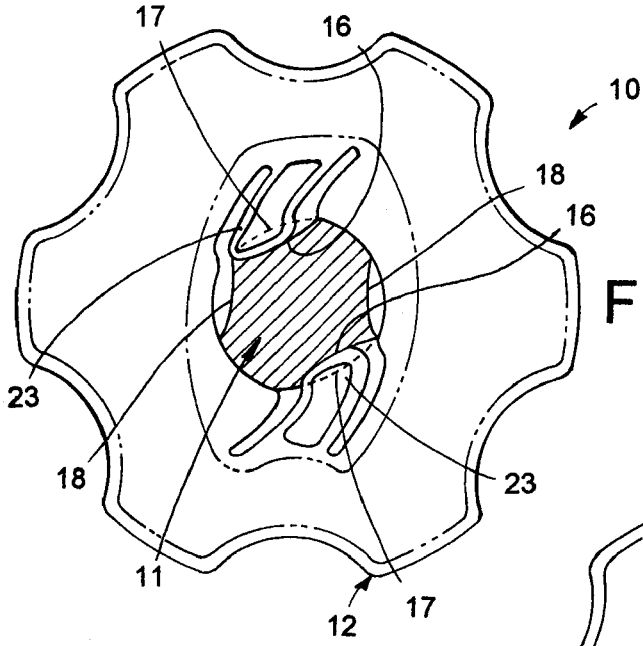
FIGS. 6-6A are end views of FIG. 1, FIG. 6 showing the weight in a locked rotational position, and FIG. 6A showing the weight rotated to an assembly-permitting rotational position.
Figure 6A:
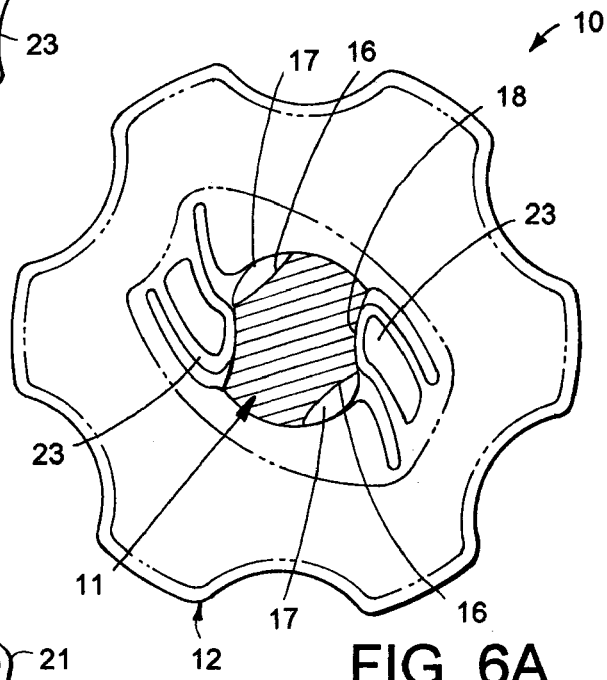

The weights 12 can be positioned on the ends of the handle 11 in an assembly-permitting first position (FIG. 6A) where the fingers 23 can slide longitudinally along the surface 18 onto the handle 11. The weights 12 include an undulating outer surface that can be grasped to rotate the weights 12 on the handle 11, so that the fingers 23 resiliently flex and rotate to engage the concave surfaces 16 between the ribs 17. (See FIG. 6.) In this rotational position, the weights 12 are locked onto the handle 11 because the fingers 23 fit between the ribs 17 and are retained axially by the ribs 17, and further the fingers 23 are retained rotationally by engagement with the concave surfaces 16. Preferably, the fingers 23 include a tip that is slightly rounded, and also the detent formed on the rod 13 between the surfaces 16 and 18 is raised and pointed, such that the fingers 23 tend to bias the weights 12 rotationally toward either an engaged/interlocked rotational position (FIG. 6), or toward the unlocked, assembly-permitting rotational position (FIG. 6A). The positive nature of this action gives the user a tell-tale positive signal that full engagement has been achieved when rotationally interlocking weights 12 onto the rod 13. Notably, the fingers 23 are slightly curved in shape and further the fingers 23 include a hollowed-out stem to facilitate flexing along their stem. The slot formed in the weights 12 around the border of the fingers 23 provides room for the fingers 23 to flex. One advantage of the present system is that a very positive feel is provided even with a relatively short movement of the fingers 23. It is noted that the illustrated fingers 23 are very durable, and further that the fingers 23 are in a protected position, such that the likelihood of damage to the fingers 23 is quite small.

The outer perimeter of each of the illustrated weights 12 includes depressions 24 to facilitate gripping and rotating the weights 12. However, it is contemplated that the weights 12 could include non-slip material or other shapes to facilitate gripping and rotation. The weights 12 can be made different sizes and with different heaviness. Advantageously, a shape of the weights 12 permits them to be assembled onto the rod 13 with either of their sides facing the rod 13 (i.e., the weights 12 are "non-handed"). Foam, rubber, or other convenient gripping material can be added to a center of the handle 11 for aesthetics, comfort, and user safety.

Advantages of the present arrangement include the fact that the dumbbell 10 is adjustable in weight, but does not require any separate locking collar(s). The weights 12 are not "handed" and will attach to either end of the handle 11 and can be assembled onto the handle 11 even if the weights 12 are inverted or "flipped". (i.e., The weights 12 are not right hand nor left hand, nor do they include an "inside" or "outside.") The system is very robust, long lasting, and durable. The fingers 23 (acetal) engage a surface (nylon) of the rod 13 in a way that is very positive. The fingers 23 basically prevent "partial" locking since their tips include a curved surface causing them to bias the weights 12 into either a rod-locked position or toward an assembly-permitting unlocked position. (Note that acetal and nylon have very low coefficient of friction, which gives a very positive feel letting the user know when the weights 12 have locked onto the rod 13.) The weights 12 can be attached out to an extreme end of the handle 11, making the system very compact. (i.e., There is no need to include an extra several inches on the end of the handle/bar, since there is no need for a locking collar.) The system is very inexpensive, and is semi-traditional since it includes only weights and a handle (and does not require a tray to hold the weights, nor does it require a selector mechanism to grip different weights).

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A method of exercising comprising steps of:

providing a rod and weights configured for self-attachment to the rod;

assembling at least one weight onto each end of the rod; and securing the weights to the ends by rotating the weights on the rod from a first rotational orientation to an interlocking second rotational orientation; wherein the rod includes opposing end sections each having a transverse cross section defining first, second, and third longitudinally-extending surfaces positioned circumferentially, and a detent between the second and third longitudinally-extending surfaces, and the at least one weight includes a hub defining a hole shaped to slide onto one of the opposing end sections; the hub including a bearing surface for slidably engaging the first longitudinally-extending surface and including at least one flexible finger with a tip extending radially inward within the hole, the step of assembly including sliding the finger along the second longitudinally-extending surface when in a first rotational orientation during assembly of the weights onto one of the end sections of the rod, and then flexing the finger over the detent and then interlocking the finger on the third longitudinally-extending surface when the weight is rotated to thus lock the weights onto the rod.

2. The method defined in claim 1, wherein the step of securing includes positioning the tip of the finger between ridges on the third longitudinally-extending surface.

3. The method defined in claim 1, wherein the step of providing the rod and weights includes overmolding plastic onto the at least one of the weights and the rod.

4. The method defined in claim 1, wherein plastic is overmolded onto both of the rod and weights.

5. An article for physical exercise, comprising:

a weight having a hub defining a hole with a center axis, an outer surface, and at least one inwardly-extending finger that extends from the hub toward the hole; the at least one finger being longitudinally curved in shape and having a tip, a flexible stem and a base, the tip being spaced radially and circumferentially from the base; the hub further including a slot formed around a border of the stem that provides room for the at least one finger to flex in a manner causing the tip to move away from the center axis, whereby the weight is adapted to receive a rod in the hole and thereafter the weight can be rotated to cause the at least one finger to flex and hence cause the tip to frictionally engage a mating surface on the rod.

6. The article defined in claim 5, wherein the stem has a hollowed-out portion.

7. The article defined in claim 6, wherein the hollowed-out portion includes spaced-apart parallel sections with a gap therebetween.

8. The article defined in claim 5, wherein the outer surface defines undulations.

9. The article defined in claim 8, wherein the undulations define concavities around an outer perimeter of the weight.

10. The article defined in claim 5, wherein the weight includes an internal metal component with plastic molded around the internal metal component.

11. The article defined in claim 5, wherein the at least one flexible finger includes two opposing flexible fingers.

12. A dumbbell comprising a rod and including at least a pair of the articles defined in claim 5 attached to the rod with the rod extending through the associated holes of the weights and with the at least one flexible finger of each weight frictionally engaging an end of the rod.

* * * * *